United States Patent [19]

Guetzlaff

[11] 4,083,215

[45] Apr. 11, 1978

[54] METHOD AND TOOL FOR MAKING A SHEET METAL PULLEY

[75] Inventor: Robert Paul Guetzlaff, Waterloo, Iowa

[73] Assignee: Deere & Company, Moline, Ill.

[21] Appl. No.: 657,154

[22] Filed: Feb. 11, 1976

[51] Int. Cl.[2] ..... B21D 22/16

[52] U.S. Cl. ..... 72/82; 72/91; 72/121; 72/125; 29/159 R

[58] Field of Search ..... 29/159 R, 159.01; 113/116 D; 72/82, 91, 120, 121, 122, 125

[56] References Cited

U.S. PATENT DOCUMENTS

| | | | |
|---|---|---|---|
| 2,061,034 | 11/1936 | Lennon | 72/91 |
| 2,062,415 | 12/1936 | Harrison | 29/159 R |
| 2,567,334 | 9/1951 | Harrison et al. | 29/159 R |
| 2,601,641 | 6/1952 | Simpson et al. | 72/82 |
| 3,087,531 | 4/1963 | Pacak | 29/159 R |
| 3,517,541 | 6/1970 | Wagner | 29/159.01 |
| 3,874,209 | 4/1975 | Maiorino | 72/91 |
| 3,893,818 | 7/1975 | Mickus | 29/159 R |

*Primary Examiner*—C.W. Lanham
*Assistant Examiner*—Daniel C. Crane

[57] ABSTRACT

The method disclosed herein briefly includes the steps of (1) forming a pair of nestled cup-like pulley hubs having radially extending flanges in side-by-side relationship and (2) rotating the nestled hubs about a rotating axis while simultaneously urging a tapered projection on the inner surface of a rotatable, annular forming tool between the side-by-side flanges to spread the flanges and form a V groove with only minor relative rotary motion between the flanges and forming tool in their areas of contact. By having the working portion of the forming tool formed on the inner portion of a rotatable, annular tool, relative rotary movement between the flanges and tool and hence galling of the flanges is kept at a minimum. The tool disclosed herein is an annular groove forming tool having the working portion thereof formed on the inner surface of the tool, the tool including the means for mounting on the same on a spinning lathe so that the tool can be used while the pulley is rotated on the lathe spindle.

19 Claims, 7 Drawing Figures

140
142
138
134
144
134

140
128
142
112
126
114
92
116
96
100
118
120
134
138
102
106
108
90
98

124
128
126
122
136
130
132
134

METHOD AND TOOL FOR MAKING A SHEET METAL PULLEY

BACKGROUND OF THE INVENTION

The present invention relates generally to a method of making a pulley from sheet metal or metal stampings, and also relates to a tool for use in making such pulley.

In the manufacture of sheet metal pulleys it is common to form at least a part thereof by a spinning process in which a spinning tool, such as a roller whose outer periphery has the configuration desired of the work piece, is forced against the rotating work piece. U.S. Pat. No. 3,633,431 which issued to Peter J. VanBussel on Jan. 11, 1972 discloses a method of making a sheet metal pulley in which a pair of metal blanks are subjected to a number of stamping operations to form a clinched assembly. As a final operation the clinched blank assembly is subjected to a spinning operation to form a V groove in the assembly. The spinning operation is performed by urging a roller with a V-shaped outer configuration between a pair of flanges to spread the flanges into the desired V shape. U.S. Pat. No. 1,680,061 which issued to R. J. Nelson on Aug. 7, 1928 and U.S. Pat. No. 2,955,748 which issued to R. J. Killian on Oct. 11, 1960 both discloses methods of making spun pulleys in which the pulley is formed completely by spinning operations. In the final operation a V groove is formed in the pulley by a spinning wheel having the desired V configuration.

The spinning operation employed in the prior art manufacturing of sheet metal pulleys has had one basic deficiency which made it difficult to control required tolerances and resulted in a high number of scrap parts. The deficiency resided in the use of the spinning wheel which is brought to bear against the rotating pulley or work piece. As the V-shaped spinning wheel progressively moved inwardly to the work piece an area or line contact between the spinning wheel and work piece along a radius of the work piece increased and this resulted in conflicting speeds at various points along the area of contact so that there was a high degree of relative sliding movement between the spinning wheel and work piece. For example, when the spinning wheel first contacts the rotating work piece, the spinning wheel is caused to rotate at a peripheral speed corresponding to the peripheral speed of the work piece. As the spinning wheel is forced inwardly to form a groove, the tip of the spinning wheel contacts a portion of the rotating work piece having a smaller diameter than the area originally contacted. This tends to reduce the speed of rotation of the spinning wheel. However, as the spinning wheel is moved inwardly the sides of the V configuration of the spinning wheel which are on a smaller diameter than the tip of the spinning wheel contact sides of the V being formed on the work piece which are on a larger diameter of the work piece than that portion being contacted by the tip of the spinning wheel and this tends to attempt to drive the spinning wheel at a higher speed. These conflicting driving forces on the spinning wheel necessarily result in relative sliding movement between the spinning wheel and work piece, and this relative sliding movement results in galling of the work piece. The degree of galling necessarily is dependent upon the force with which the spinning wheel is forced against the work piece and the amount of relative movement between the spinning wheel and work piece.

SUMMARY OF THE INVENTION

The principal objects of the present invention are to provide a method of making a sheet metal pulley which includes a spinning operation in which, when compared to the prior art, relative minor sliding movement between the pulley or work piece and the forming tool is required, and to provide a tool for the use in such method.

A specific object of the present invention is to provide a method of making a sheet metal pulley in which the pulley groove is formed by a spinning operation in which the forming tool used is annular in form and has its working surface formed on the inner surface thereof to thereby reduce the relative sliding movement between the pulley and forming tool.

Another specific object of the present invention is to provide a forming tool for use in a spinning operation for making a groove in a sheet metal pulley, the forming tool including an annular rotatably mounted member having its inner portion shaped in conformance with the desired groove configuration.

The above objects and additional objects and advantages of the present invention will become apparent to those skilled in the art from a reading of the following detailed description when taking in conjunction with the accompanying drawings.

DESCRIPTION OF THE PREFERRED EMBODIMENT

Figure 1:
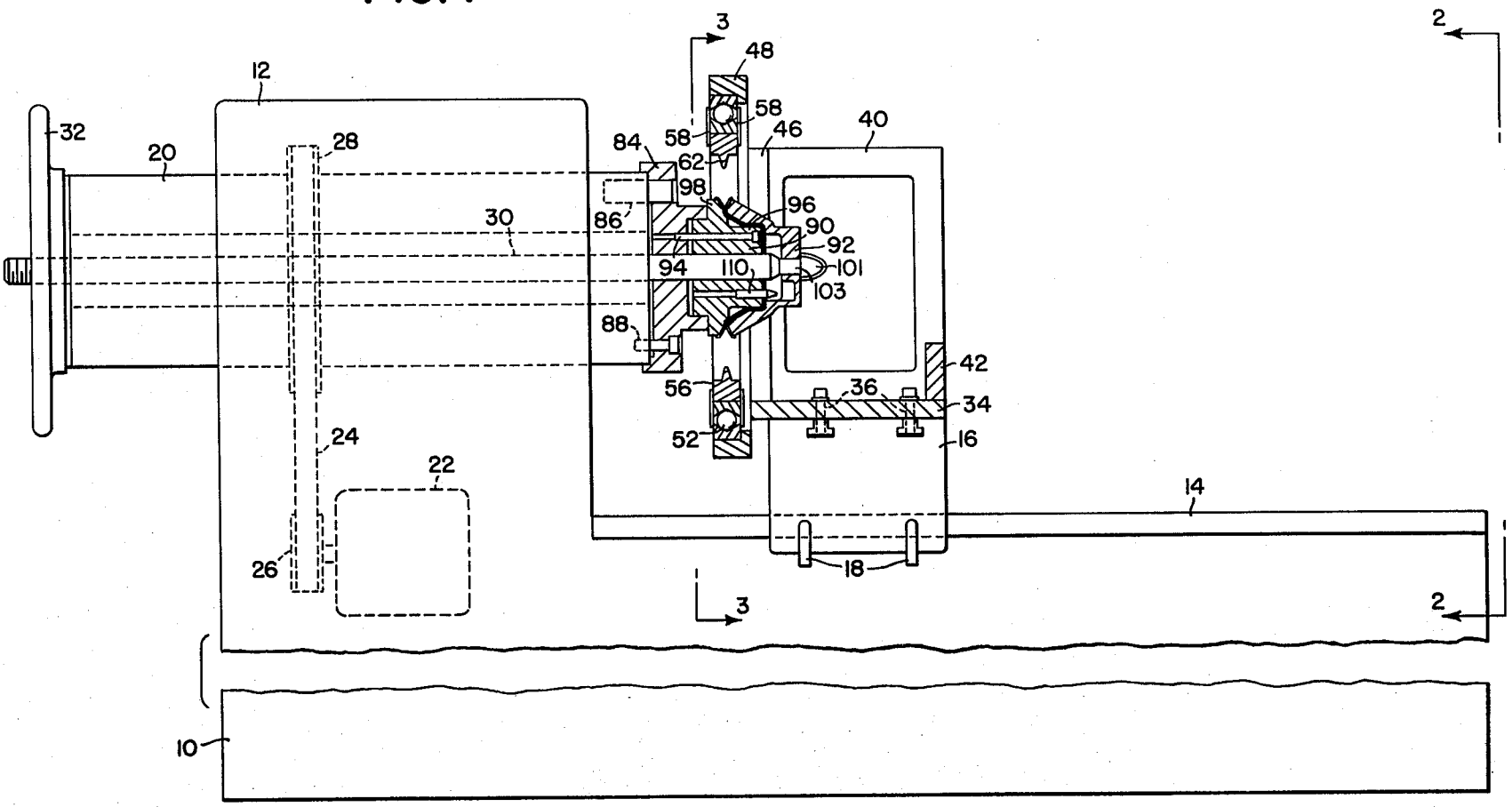
FIG. 1 is a side elevational view, partly in section and with certain parts omitted for clarity, of a forming tool constructed in accordance with the principles of the present invention mounted on a conventional spinning lathe.
Figure 2:
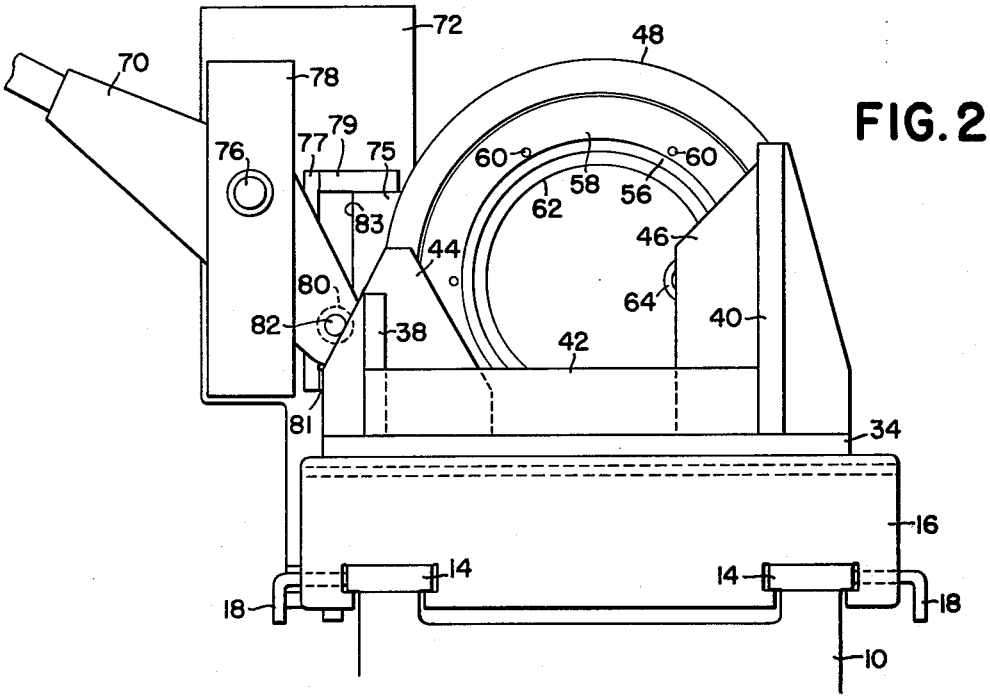
FIG. 2 is a right end view of the machine illustrated in FIG. 1 and looking generally along the lines 2—2 of FIG. 1.
Figure 3:
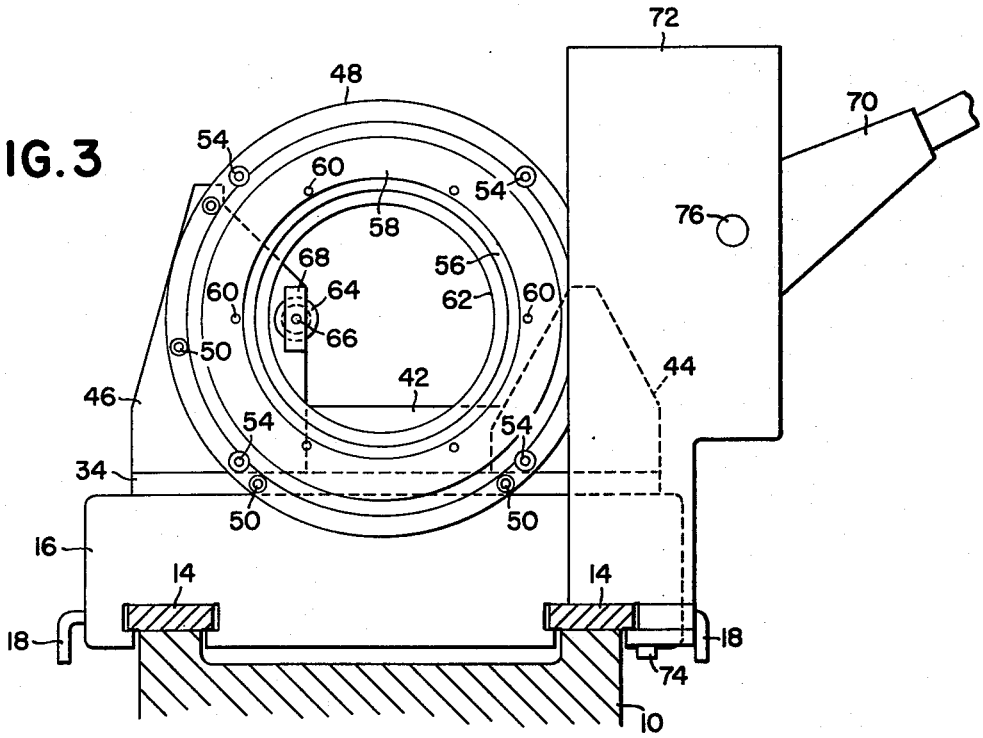
FIG. 3 is a sectional view taken substantially along the line 3—3 of FIG. 1, with certain parts omitted for the purpose of clarity.

Referring now to the drawings, and in particular to FIGS. 1 through 3, a conventional spinning lathe is illustrated as including a base 10, a headstock 12 an a bed consisting of a pair of spaced rails 14. A saddle 16 is slidably mounted on the rails 14 of the bed and can be secured in any desired position by fasteners 18. A spindle 20 is rotatably mounted in the headstock 12 and is driven by a motor 22 through an endless flexible belt or chain 24 which is trained around pulleys 26 and 28 mounted on the shaft of the motor 22 and the spindle 20 respectively. The spindle 20 is hollow, and a clamp bar 30 extends therethrough and has a threaded end projecting from the spindle at the end thereof remote from the bed of the spinning lathe. The threaded end of the clamp bar 30 is threaded through an adjusting hand wheel 32. The spinning lathe thus described is intended to be representative of any known spinning lathe and by itself forms no part of the present invention other than the fact that the present invention is used with a spinning lathe of this type.

A support for the forming tool of the present invention includes a base plate 34 slidably mounted and guided on the saddle 16 by bolts 26 which have enlarged T-shaped heads positioned in T-shaped grooves provided in the saddle 16. The forming tool support also includes front and rear vertical support plates 38 and 40, respectively, a right support plate 42 extending between and secured to the front and rear support plates, and front and rear vertically extending left support plates 44 and 46, respectively, secured to the front and rear support plates 38 and 40 respectively. As can be seen in FIG. 1, the rear support plate 40 has its inner section removed to form a hollow framework, but this is only for the purpose of reducing the amount of material used.

An annular forming tool housing 48 is secured to the left support plates 44 and 46 by cap screws 50. A ball bearing assembly 52 is carried by the housing 48 and is secured therein by cap screw and washer assemblies 54 which extend into the housing and overlap the outer race of the bearing. An annular forming tool 56 is carried on the inner race of the bearing and a pair of bearing shields 58 are secured to the forming tool by fasteners 60 and extend outwardly to overlap the bearing inner race and at least a portion of the bearing outer race.

The inner surface of the annular forming tool 56 is provided with a generally V-shaped projection 62 which would have a configuration identical to the configuration of the groove to be formed in a pulley. The base of the V-shaped projection 62 is narrower than the width of the forming tool and the two sides of the V turn into outwardly extending lateral projections for a purpose to be more fully explained hereinafter.

A small splitter wheel 64 is also mounted on the rear left support plate 46 on the same side thereof as the forming tool housing. The splitter wheel 64 is mounted for rotation about a central pin 66 which extends between the support plate 46 and the bite of the U-shaped bracket 68 which has its legs secured to the support plate 46. The sides of the relatively small diameter splitter wheel 64 taper outwardly to a sharp point and the splitter wheel is mounted inside the forming tool in alignment with the forming tool so that the pointed outer periphery of the splitter wheel and the innermost portion of the V projection on the forming tool lie in a common plane.

Sliding reciprocal movement of the forming tool and its support frame on the lathe saddle occurs under the control of a manually operable lever 70 which is pivotably mounted intermediate its ends on a frame 72. The lower foot of frame 72 is clamped to one of the rails 14 by a bolt 74 to retain the frame in an adjusted position on the lathe. The lever 70 is pivoted intermediate its ends about a pin 76 which extends between the frame 72 and the bite of a U-shaped bracket 78 secured to the frame 72. The end of the lever 70 closest to the forming tool carries a cam roller 80 which is secured thereon by a pin 82. The cam roller 80 rides in a slot 83 formed by a pair of side blocks 75 and 77, an upper block 79 and a lower block 81. The blocks 75, 77, 79 and 81 are secured together to form the slot 83 and the block 75 is secured to the forming tool housing 48 in any suitable manner such as with cap screws. The front and rear sides of the slot 83 form cam surfaces which cooperate with the cam roller 80 to slide the forming tool and forming tool housing back and forth on the saddle 16 upon pivotal movement of the lever 70.

Figures 4, 5, 6:
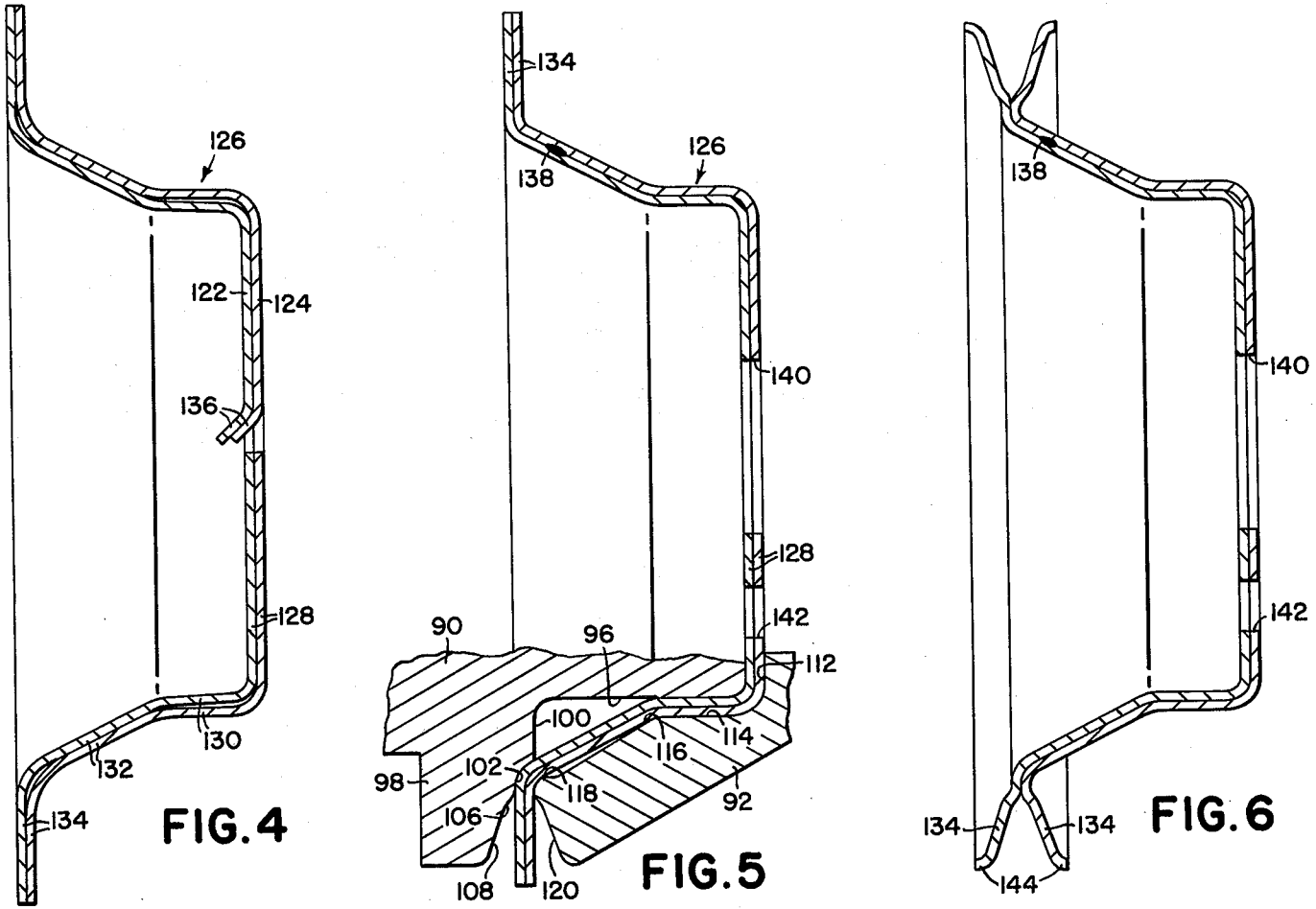
FIGS. 4 through 6 are sectional views of a sheet metal pulley after successive steps in its manufacture.

In order to mount a work piece or partially formed pulley on the lathe spindle, a pulley nest head 84 is secured to the end of the spindle opposite from the hand wheel 32. The nest head 84 is pivoted on pins 86 and secured in position by cap screws 88. the purpose of a head is to provide for interchangeability of pulley nests. The pulley nests consists of inner and outer sections 90 and 92 respectively. The inner nest section 90 is secured in position on the head 84 by cap screws 94. Inner section 90 is provided with a circular center portion 96 which is adapted to extend into a cup shaped hub portion of a work piece or partially formed pulley 126. The partially formed pulley which will be mounted in the pulley nest is illustrated in FIG. 5. A flanged portion 98 of the inner section of the nest is located inwardly from the outer end of the central circular portion and extends outwardly therefrom. The face of the flange facing away from the lathe spindle includes a flat portion 100, a first arcuate portion 102 joined with the outer part of the flat portion 100 through a rounded corner, a second arcuate portion 106 joined with the arcuate portion 102 through a rounded corner, and a tapered portion 108 which joins the arcuate portion 106 through a rounded corner. The tapered portion 108 extends outwardly in a taper correspnding to one-half of the V groove to be formed in the work piece. The configuration of the flange 98 can best be seen in FIG. 5 where a portion thereof is shown in proper relationship with the work piece. One or more pins 110 extend from the face of the circular portion of the inner portion of the nest and will extend through mounting holes in the work piece when the work piece is clamped in the nest and resist any tendency of the work piece to rotate with respect to the nest.

The outer section of the pulley nest is generally of complementary form to the first section and includes a hollow body which is adapted to snugly fit over the outer portion of the work piece and clamp a pair of side-by-side flanges extending outwardly from the hub of the work piece against the flange on the inner section of the nest. The hollow inner surface of the outer section of the nest includes a radial flat face portion 112 which engages the flat face of the hub of the work piece and clamps the same against the face of a central portion of the inner section of the nest, an annular wall portion 114 which engage the sides of the cup shaped hub portion of the work piece, a conical shaped wall section 116 which is substantially complementary to a conical shaped portion of the cup shaped hub of the work piece. A beaded corner section 118 which is adapted to engage the base of side-by-side flanges on the work piece and clamp the same against the arcuate section 102 of the face of the flange 98, and a tapering section 120 complementary to the tapering section 108 on the flange 98.

For the purpose of clamping the two sections of the nest together, the clamp bar 30 extends through central openings, provided in the nest head 84 and inner nest section 90 and terminates in a flat, spearhead shaped end 101 joined with the main portion of the clamp bar through a reduced diameter section 103 of the clamp bar. The outer section of the nest is provided with a slot opening for receiving the spearhead shaped end of the clamp bar so that relative rotation between the outer section and clamp bar locks the outer section on the clamp bar.

The operation of the forming tool thus far described will be explained in a description of the method according to the present invention, and the method according to the present invention is best explained by reference to FIGS. 4 through 6. According to the method of the present invention two pieces of sheet metal 122 and 124 are brought together and subjected to a blanking operation which forms a pair of substantially circular parts. The two parts are then subjected to a drawing operation which forms the parts into the general shape of a pulley hub indicated generally at 126 and including a pair of nestled cup shaped members. The nestled cup shaped members each include a flat radial end or bottom wall 128, an annular wall portion 130 connected to the wall 128, a conical wall portion 132 connected to the annular wall portion 130 and flanges 134 extending radially outwardly from the conical wall portion 132. The nestled cup shaped members are also subjected to a lancing operation which forms locking tabs 136 which serve to temporarily hold the two separate pieces in their nestled relationship. The blanking, drawing, and lancing operations are preferably performed simultaneously, but may, if desired, be performed as separate operations. The nestled cup shaped members 126 formed by the blanking, drawing, and latching operation is illustrated in FIG. 4.

The cup shaped members previously formed are then subjected to a spot welding operation which unitarily joins the two members at various locations, such locations being indicated at 138.

As can be seen in FIG. 4, the drawn cup shaped members do not completely conform to each other, particularly in the area of the bends or corners. To overcome this situation the unitary cup shaped structure 126 formed by the spot welding operation is subjected to a restriking operation which further forms the parts into complete conformity with each other as illustrated in FIG. 5. The unitary structure is also punched to form a central shaft opening 140 and a plurality of bolt holes 142 in the flat end face 128 as is illustrated in FIG. 5. As can be seen by comparing FIG. 4 and FIG. 5, the punching operation removes the locking tabs 136. The outer edges of the flange 134 is also trimmed if necessary. The restriking, punching, and trimming operations are preferably performed simultaneously, but may, if desired, be performed as separate operations.

After the restriking, punching, and trimming, the unitary cup shaped hub structure is mounted in the pulley nest between the inner and outer sections thereof as is illustrated in FIG. 1 and partially illustrated in FIG. 5. The partially formed pulley 126 is tightly clamped between the inner and outer sections 90 and 92 of the nest by tightening of the clamp bar 30.

It should be noted at this point that the carriage 16 will have been adjusted along the length of the bed 14 so that when the partially formed pulley 126 is mounted in the pulley nest, the two side-by-side flanges 134 of the unitary joined sections of the partially formed hub are in perfect alignment with the splitter wheel 64 and the V-shaped projection 62 on the forming tool 56. The forming tool is then moved, by manipulation of the lever 70, to bring the splitter wheel 64 into engagement with the outer edges of the flanges 134. The spinning lathe is then started, and, with the partially formed pulley rotating, the splitter wheel 64 is, by raising the outer end of the lever 70, forced between the two flanges to provide initial separation. The spinning lathe is then stopped and the lever 70 lowered to bring the outer tip of the V-shaped projection 72 on the forming tool 56 into engagement with the flanges 134. The relatively blunt tip on the V-shaped projection 62 partially extends between the two flanges 134 due to the initial separation provided by the splitter wheel 64. The spinning lathe is again started and the lever 70 lowered to force the V-shaped projection between the flanges 134.

As the V-shaped projection 62 progresses inwardly between the flanges 134, the flanges 134 are forced outwardly to conform to the shape dictated by the shape of the projection 162 and the shape of the sloping surfaces 108 and 120 on the inner and outer sections, respectively, of the pully nest. The V-shaped projection is forced inwardly far enough to cause the outer ens of the flanges 134 to engage the lateral extensions at the base of the V-shaped projection 62 and be turned outwardly indicated at 144 in FIG. 6. The lever 170 is then raised to remove the V-shaped projection from the formed groove and the finished pulley, illustrated to FIG. 6, is removed from the pulley nest.

Figure 7:
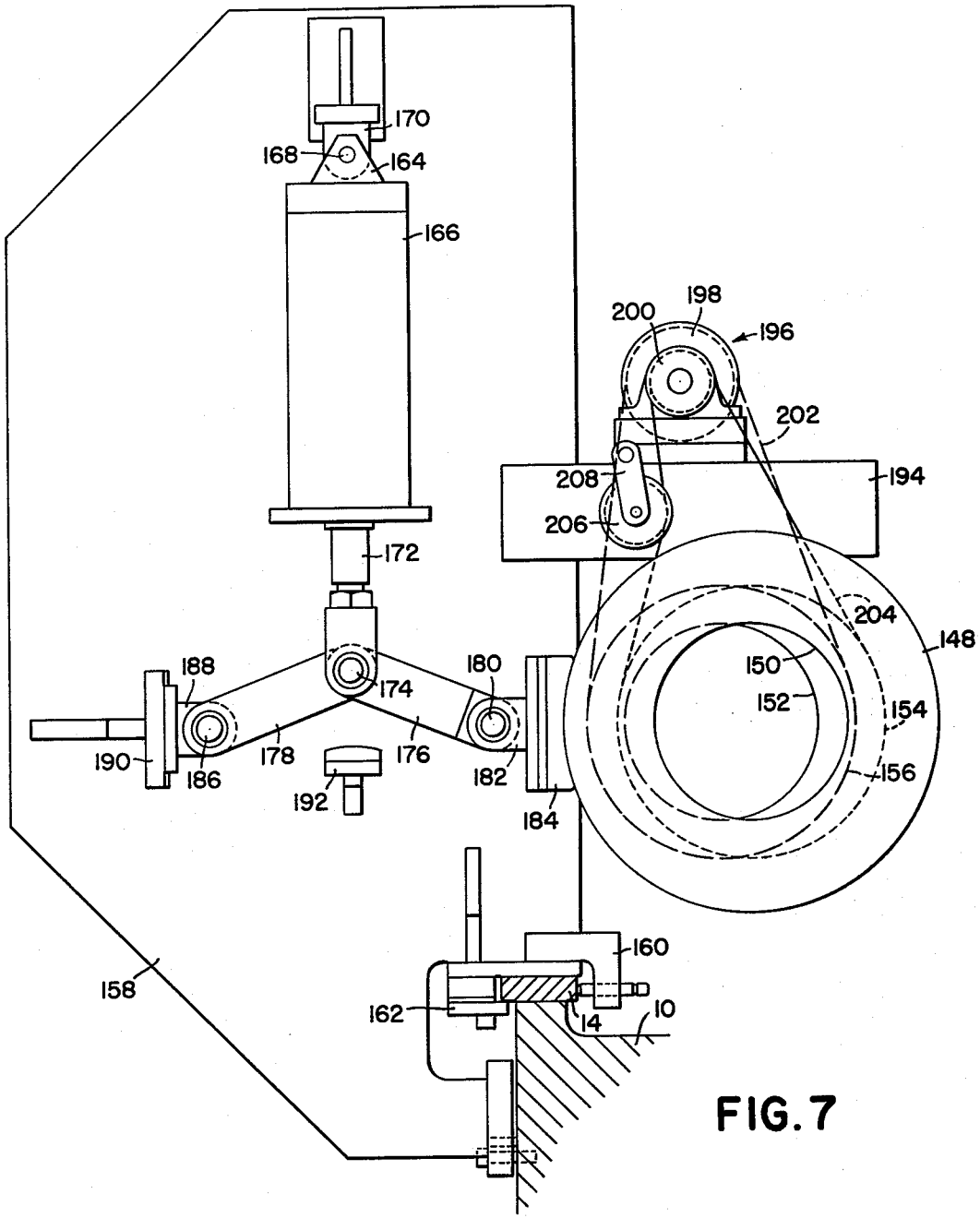
FIG. 7 is an end elevational of a modification of the forming tool according to the present invention.

A modified form of the actuating mechanism for the forming tool is illustrated in FIG. 7 in which only those portions of the spinning lathe and forming tool necessary for an understanding of the invention are illustrated. In FIG. 7, circle 148 indicates the outside diameter of the forming tool housing, circle 150 indicates the inside diameter of the V-shaped projection on the forming tool, circle 152 indicates the outside diameter of the spinning lathe spindle, circle 154 indicates the outside diameter of a sprocket fixed to the forming tool and circle 156 indicates the outside diameter of a sprocket fixed to the spindle. The purpose of the sprockets will be more fully explained hereinafter.

A support frame 158 is mounted on the bed 10 of the spinning lathe by clamps 160 and 162 which engage one of the bed rails 14. The anchor end 164 of a hydraulic cylinder 166 is pivotally mounted on a pin 168 on a bracket 170 secured to an upper portion of the support frame 158. A rod 172 extends from the hydraulic cylinder and is pivotally connected by a pin 174 to one end of each of a pair of rigid links 176 and 178. The opposite end of the link 176 is pivotally connected by a pin 180 to an ear 182 on an attaching block 184 which is secured to the forming tool housing 148 in any suitable manner such as through the use of cap screws. The opposite end of the link 178 is pivotaly connected by a pin 186 to an ear 188 on a bracket 190 secured to the support plate 158. The links 176 and 178 form a toggle linkage which, upon extension of the rod 172 from the hydraulic cylinder 166 forces the forming tool to the right as viewed in FIG. 7 and upon retraction on the rod 172 into the cylinder 176 move the forming tool to the left as viewed in FIG. 7. Movement of the forming tool to the right is limited by engagement between the links 176 and 178 and a stop block 192 secured on the support plate 158.

A rigid arm 194 is secured to the support plate 158 and extends outwardly therefrom over the spinning lathe. An overrunning clutch mechanism indicated generally at 196 is mounted on the arm 194 and includes an input sprocket 198 and an output sprocket 200, a drive chain 202 is trained about the input sprocket 198 of the overrunning clutch and the sprocket 156 on the spindle 152. An additional drive chain 204 is trained about the output sprocket 200 of the overrunning clutch 196 and the sprocket 154 secured to the forming tool. A spring loaded idler wheel 206 is mounted on the arm 194 through a pivoted arm 208 and engages the drive chain 204 to keep the same reasonably taunt as the forming tool is slid back and forth by the actuating mechanism.

The function of the actuating mechanism illustrated in FIG. 7 is the same as the function of the actuating mechanism in the first embodiment of the invention, but avoids the requirement for manual input and is intended for use with an automatic machine. By driving the forming tool through the overrunnin clutch it is not necessary to start and stop the operation of the spinning lathe during the forming process. Specifically, by having the forming tool rotating at substantially the same rate as the partially formed pulley, the galling which could occur by bringing a nonrotating forming tool into engagement with a rotating work piece is eliminated. Because of the small size of the splitter wheel galling is not really a problem when the non-rotating splitter wheel is brought into engagement with the rotating work piece, Thus, it can be seen that driving of the forming tool at a rate substantially equal to the rate of rotation of the pulley also adapts the use of the forming tool to an automatic operation. The overrunning clutch takes care of slight variations in speed between the work piece and forming tool.

The operation of the embodiment illustrated in FIG. 7 should be obvious to those skilled in the art, but basically is similar to the operation of the first embodiment of the invention with the exceptions that it is not necessary to stop and start the spinning lathe and rather than raising and lowering the lever 70 as is required in the first embodiment of the invention, fluid under pressure is admitted to the opposite ends of the hydraulic cylinder 166 to retract and extend the rod 172.

Having thus described preferred embodiments of the inventions, various modifications within the spirit and scope of the invention will become apparent to those skilled in the art and can be made without departing from the underlying principles of the invention. Therefore, the method and apparatus of the present invention should not be limited to the specific illustrations and detailed descriptions, but only by the following claims.

I claim:

1. A pulley forming attachment for a spinning lathe comprising: a pulley nest mountable on a lathe headstock spindle for rigidly supporting a partially formed pulley having a pair of side-by-side radially extending flanges for rotation with the spindle and about the spindle axis; a forming tool support slidably mountable on the lathe carriage for movement perpendicular to the lathe headstock spindle; a forming tool housing carried on the support; a forming tool including an annular member having an internal diameter greater than the diameter of the radially extending flanges on the partially formed pulley, the inner portion of the annular member including a V-shaped projection terminating at an inner tip adapted to pass between the side-by-side radial flanges; and bearing means rotatably mounting the forming tool to the housing with the inner tip of the V-shaped projection lying in a plane perpendicular to the axis of the lathe spindle.

2. The invention as set forth in claim 1 wherein the width of the annular member is greater than the width of the V-shaped projection at its base to form laterally extending continuations of the V-shaped projection whereby, as the V-shaped projection passes between the side-by-side radial flanges, the outer portions of the side-by-side radial flanges contact the laterally extending continuations and are turned outwardly.

3. The invention as set forth in claim 1 further including a spreader wheel having tapered surfaces terminating in a sharp outer periphery and having an outside diameter less than the inside diameter of the forming tool, and the spreader wheel is rotatably mounted on the support inside the forming tool with its sharp outer periphery lying in the same plane as the inner tip of the V-shaped projection on the annular member.

4. The invention as set forth in claim 3 wherein the outside diameter of the spreader wheel is less than the difference between the inside diameter of the forming tool and the diameter of the radially extending flanges on the partially formed pulley, and the spreader wheel is mounted with a portion of its outer periphery closely adjacent to a portion of the inner periphery of the forming tool whereby both the spreader wheel and the partially formed pulley fit with the annular member.

5. The invention as set forth in claim 4 wherein the annular member of the forming tool and the splitter wheel each has a diameter lying in a common plane parallel to the direction of sliding movement of the forming tool support on the lathe carriage and intersecting the axis of rotation of the lathe spindle.

6. The invention as set forth in claim 4 further including actuator means mountable on the lathe bed and acting on the forming tool housing to slide the forming tool, forming tool housing and forming tool support in opposite directions whereby, when the forming tool is moved in a first direction by the actuator means, the splitter will provide initial separation of the side-by-side flanges and, when the forming tool is moved in a second, opposite direction by the actuator means, the V-shaped projection on the annular member passes between the side-by-side flanges to spread the flanges and form a V-groove.

7. The invention as set forth in claim 6 wherein the actuator means includes a frame secured to the lathe bed, a lever pivotally mounted intermediate its ends on the frame, a cam block secured to the forming tool housing and having an elongated slot provided therein with the opposite edges of the slot forming a pair of cam surfaces, and a cam member mounted on one end of the lever and projecting into the elongated slot whereby pivotal movement of the lever causes the cam member to act on the cam surfaces to move the forming tool.

8. The invention as set forth in claim 6 wherein the actuator means includes first bracket means secured to the forming tool housing, a frame secured to the lathe bed, second bracket means secured to the frame, a pair of rigid links pivotally interconnected and pivotally connected to the first and second bracket means to form a toggle, and a double acting hydraulic cylinder having one end anchored to the frame and its opposite end secured to the toggle to move the toggle toward and away from an on-center position upon actuation thereof.

9. The invention set forth in claim 8 further including drive means connectable between the lathe spindle and the forming tool for driving the forming tool at an innr surface speed substantially equal to the outer periphery speed of the flanges, the drive means including overrunning clutch means to permit the forming tool to be driven at a faster rate by engagement with the flanges.

10. A tool for use in forming a groove in a partially formed pulley having a pair of side-by-side radial flanges, said tool comprising: a spinning lathe including a bed, a driven spindle having one end projecting over the bed and a carriage mounted on the bed; a pulley nest mountable on the one end of the spindle and including first and second sections for clamping the partially formed pulley therebetween; a forming tool support slidably mounted on the carriage for reciprocal movement perpendicular to the axis of rotation of the spindle;

an annular forming tool having an internal diameter greater than the diameter of the pulley flanges rotatably mounted on the support for reciprocal movement with the support rotation with respect to the support; the inner portion of the forming tool having a configuration similar to the configuration of the groove to be formed; and actuator means supported on the lathe and acting as the forming tool to urge the inner portion of the forming tool between the side-by-side flange to form a groove therewith.

11. A tool as set forth in claim 10 wherein a splitter wheel having side faces tapering from a central portion to an outer tip on the periphery of the wheel is rotatably mounted on the support with its outer tip lying in the same plane as the inner portion of the forming tool and completely within the internal diameter of the forming tool, and the actuator means includes means to move the forming tool in both directions of the reciprocal movement of the forming tool support whereby, when the forming tool and support are moved in a first direction by the actuator means, the outer tip of the splitter wheel is urged between the flanges to initially spread the flanges and, when the forming tool and support are moved in a second direction by the actuator means, the inner portion of the forming tool is moved between the initially spread flanges to form a groove.

12. A tool as set forth in claim 11 wherein the first and second sections of the pulley nest clamp inner portion of the side-by-side flanges and include backup surfaces spaced from the flanges and shaped complementary to the inner portion of the forming tool whereby, as the inner portion of the forming tool is urged between the flanges, the flanges are forced to take the shape of the backup surfaces and inner portions of the forming tool.

13. A tool as set forth in claim 11 wherein the actuator means includes a cam block secured to the support and having an elongated slot provided therein to form a pair of opposed cam surfaces with its opposed edges, a frame secured to the lathe bed, a lever pivotally mounted intermdiate its end on the frame, and a cam member mounted on one end of the lever and projecting into the slot to engage the opposed cam surfaces upon pivotal movement of the lever in opposite directions.

14. A tool as set forth in claim 11 wherein the actuator means includes first bracket means secured to the support, a frame mounted on the lathe bed, second bracket means secured to the frame, a pair of rigid, pivotally connected links pivoted to the first and second bracket means to form a toggle therebetween, and a hydraulic cylinder connected between third bracket means on the frame and the toggle to move the toggle toward and away from an on-center position upon actuation thereof.

15. A tool as set forth in claim 14 further including drive means connected between the lathe spindle and the forming tool for driving the forming tool at an inside diameter speed substantially equal to the peripheral speed of the flanges, the drive means having overrunning clutch means permitting engagement between the flanges and forming tool to drive the forming tool at a faster rate than the drive means.

16. A tool as set forth in claim 10 wherein the inner portion of the annular forming tool includes a pair of outwardly tapering surfaces to force the flanges into a V-groove configuration.

17. A tool as set forth in claim 16 wherein the forming tool includes oppositely extending lateral surfaces at the bases of the tapering surfaces, the first and second sections of the pulley nest clamp inner portions of the flanges and include a pair of opposed backup surfaces which diverge outwardly from the point of clamping and terminate in oppositely extending lateral surfaces, and the actuator means urges the inner portion of the forming tool between the flanges a distance greater than the distance between the bases and tips of the tapering surfaces whereby the tapering surfaces and backup surfaces cooperate to form the pulley flanges into a V-groove and the lateral surfaces cooperate to form the outer portions of the pulley flanges into groove flanges.

18. A tool as set forth in claim 17 wherein the actuator means includes first bracket means secured to the support, a frame mounted on the lathe bed, second bracket means secured to the frame, a pair of rigid, pivotally connected links pivoted to the first and second bracket means to form a toggle therebetween, and a hydraulic cylinder connected between third bracket means on the frame and the toggle to move the toggle toward and away from an on-center position upon actuation thereof.

19. A tool as set forth in claim 18 further including drive means connected between the lathe spindle and the forming tool for driving the forming tool at an inside diameter speed substantially equal to the peripheral speed of the flanges, the drive means having overrunning clutch means permitting engagement between the flanges and forming tool to drive the forming tool at a faster rate than the drive means.

* * * * *